US005788094A

United States Patent [19]

Kim et al.

[11] Patent Number: 5,788,094

[45] Date of Patent: Aug. 4, 1998

[54] REFRIGERATOR SHELF STRUCTURE HAVING STOPS FOR LIMITING FORWARD AND REARWARD SLIDING MOVEMENT OF A SHELF

[75] Inventors: Ik Geun Kim; Sang Chul Ryu, both of Suwon, Rep. of Korea

[73] Assignee: Samsung Electronics Co., Ltd., Suwon, Rep. of Korea

[21] Appl. No.: 694,296

[22] Filed: Aug. 8, 1996

[30] Foreign Application Priority Data

Nov. 30, 1995 [KR] Rep. of Korea ..... 95-45713

[51] Int. Cl.[6] ..... A47F 7/00

[52] U.S. Cl. ..... 211/153

[58] Field of Search ..... 211/153, 134, 211/175, 164, 94; 108/107, 108, 143; 312/404, 408, 410

[56] References Cited

U.S. PATENT DOCUMENTS

| | | | |
|---|---|---|---|
| 1,934,125 | 11/1933 | Hurt | 211/153 X |
| 2,033,792 | 3/1936 | Sywert et al. | 211/153 |
| 3,070,417 | 12/1962 | Jacobs et al. | 312/410 |
| 3,169,813 | 2/1965 | Cannon et al. | 312/404 X |
| 4,904,032 | 2/1990 | Jenkins | 108/107 X |
| 4,936,641 | 6/1990 | Bussan et al. | 211/134 X |
| 5,273,354 | 12/1993 | Herrmann et al. | 312/408 |
| 5,299,863 | 4/1994 | Albright, Jr. | 312/404 |
| 5,303,997 | 4/1994 | Kropf | 312/410 X |

*Primary Examiner*—Alvin C. Chin-Shue
*Assistant Examiner*—Sarah L. Purol
*Attorney, Agent, or Firm*—Burns, Doane, Swecker & Mathis, L.L.P.

[57] ABSTRACT

A shelf construction in a refrigerator includes a pair of guide rails provided on opposite side walls of a refrigerator compartment. A shelf slides forwardly and rearwardly along the guide rails. Two front stop beads are provided at respective front portions of the guide rails, and two rear stop beads are provided at respective rear portions of the guide rails. Stoppers project from the shelf in an area bordered by the front and rear stop beads. The stoppers come into contact with the front beads as the shelf slides forwardly, thereby limiting the forward movement of the shelf. The stoppers also come into contact with the rear beads as the shelf slides rearwardly, thereby limiting the rearward movement of the shelf.

3 Claims, 2 Drawing Sheets

REFRIGERATOR SHELF STRUCTURE HAVING STOPS FOR LIMITING FORWARD AND REARWARD SLIDING MOVEMENT OF A SHELF

BACKGROUND OF THE INVENTION

1. Field of the Invention

The present invention relates to a shelf construction used in refrigerators, and more particularly to a shelf construction of a refrigerator including a shelf slidable along guide rails when the shelf is pushed or pulled.

2. Description of the Prior Art

Typically, refrigerators comprise a refrigerator body, an outer wall of which includes an outer case and an inner panel. The space between the outer case and inner panel is filled with an insulating material such as polyurethane foam. The interior of the refrigerator body is vertically or laterally divided into a freezer compartment and a fresh food compartment by a partition which extends horizontally or vertically between the compartments.

The freezer compartment is provided with an ice tray and a shelf whereas the fresh food compartment is provided with a vegetable tray and a shelf. Various door shelves or guards are also provided on respective doors of the freezer and fresh food compartments.

Such shelves of the freezer and fresh food compartments can slide forwardly and rearwardly along a pair of guide rails formed at both side walls of a refrigerator cabinet defined by the inner panel. Such a slidable shelf construction is disclosed in U.S. Pat. No. 5,299,863. Although such shelves may be integrally connected together so that they may move altogether along upper and lower guide rail pairs, as in U.S. Pat. No. 5,299,863, it is common to construct shelves such that they can individually slide along respective guide rail pairs. In this case, however, there is a problem that each shelf may strike against the rear wall portion of the inner panel when it is pushed too far rearward and/or it may separate from the corresponding guide rails when it is pulled too far forward.

For example, U.S. Pat. No. 5,273,354 discloses a lower shelf constructed to slide along guide rails formed integrally with an upper shelf. This patent also discloses a plurality of downwardly extending stoppers which are respectively provided at front and rear portions of both side surfaces of the lower shelf to prevent the lower shelf from forwardly and rearwardly separating from the guide rails. The stoppers selectively come into contact with beads provided at the front portions of the guide rails.

Such stoppers may be applied generally to shelves constructed to slide along guide rails formed on a refrigerator cabinet as well as the lower shelf constructed to slide along guide rails formed on the upper shelf as in the above-mentioned patent.

Japanese Utility Model Laid-open Publication Sho57-157895A also discloses stoppers installed on the shelf.

Referring to FIGS. 1A and 1B, a conventional shelf construction provided with the above-mentioned stoppers is illustrated.

As shown in FIGS. 1A and 1B, the construction comprises a shelf 90 constructed to slide forwardly and rearwardly along guide rails formed at both side walls of a refrigerator cabinet 7. When the shelf 90 is pushed too far rearward into the interior of the refrigerator, it may strike against the rear wall portion of the refrigerator cabinet 7. In order to prevent such a phenomenon, the shelf 90 is provided at its front end with a pair of downwardly extending stoppers 90A integral with the shelf 90. Each guide rail 80 also has a bead 100 having inclined surfaces 100A and 100B. Each stopper 90A comes into contact with the inclined surface 100A of each corresponding bead 100 as the shelf 90 slides rearwardly, thereby causing the shelf 90 to stop its further rearward sliding movement, as shown in FIG. 1A.

When the shelf 90 is pulled too far forward, it may separate from the guide rails 80 of the refrigerator cabinet 7. In order to prevent such a separation, the shelf 90 is also provided at its central portion with a pair of downwardly extending stoppers 110 integral with the shelf 90. Each stopper 110 comes into contact with the inclined surface 100B of each corresponding bead 100 as the shelf 90 slides forwardly, thereby causing the shelf 90 to stop its further forward sliding movement, as shown in FIG. 1B.

However, such a shelf construction is complex because the stoppers 90A and 110 should be formed at certain portions of the shelf 90, respectively, the location of which make it difficult to form the shelf 90 using an section molding method.

Furthermore, the shelf 90 has a poor appearance because the stoppers, in particular, stoppers 90A formed at the front end of the shelf 90 protrude downwardly.

In addition, the stoppers are also problematic in terms of safety cause they may injure the user's hand when the user forwardly pulls shelf unless he takes special care.

SUMMARY OF THE INVENTION

Therefore, an object of the invention is to provide a shelf construction of a refrigerator having a simple and safe structure.

In accordance with the present invention, this object is accomplished through a shelf construction of a refrigerator comprising a pair of guide rails provided at opposite side walls of a refrigerator cabinet, a shelf constructed to slide forwardly and rearwardly along the guide rails, and stoppers adapted to limit the forward and rearward sliding movements of the shelf. The stopper means comprises: a pair of front beads provided at respective front portions of the guide rails; a pair of rear beads provided at respective rear portions of the guide rails; and stoppers respectively provided at opposite sides of a central portion of the shelf such that they come into contact with the front beads as the shelf slides forwardly, thereby limiting the forward movement of the shelf whereas they come into contact with the rear beads as the shelf slides rearwardly, thereby limiting the rearward movement of the shelf.

BRIEF DESCRIPTION OF THE DRAWINGS

Other objects and aspects of the invention will become apparent from the following description of embodiments with reference to the accompanying drawings in which.

DETAILED DESCRIPTION OF A PREFERRED EMBODIMENT

Figure 1A:
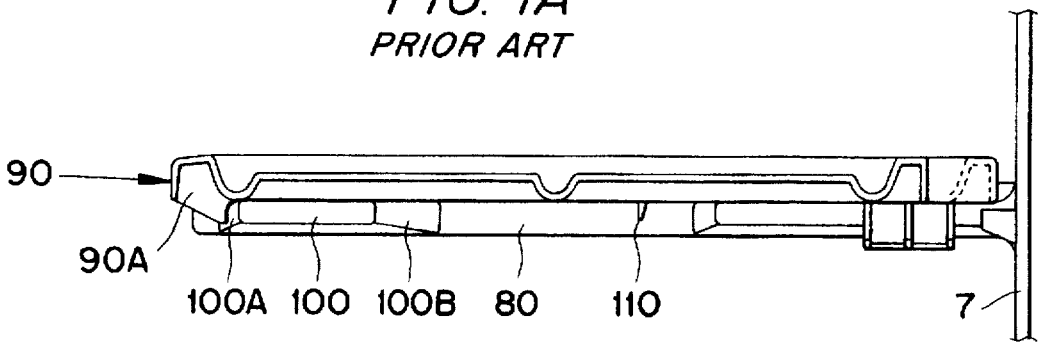
FIG. 1A PRIOR ART
FIGS. 1A and 1B are sectional views respectively illustrating a conventional shelf construction used in refrigerators.
Figure 1B:
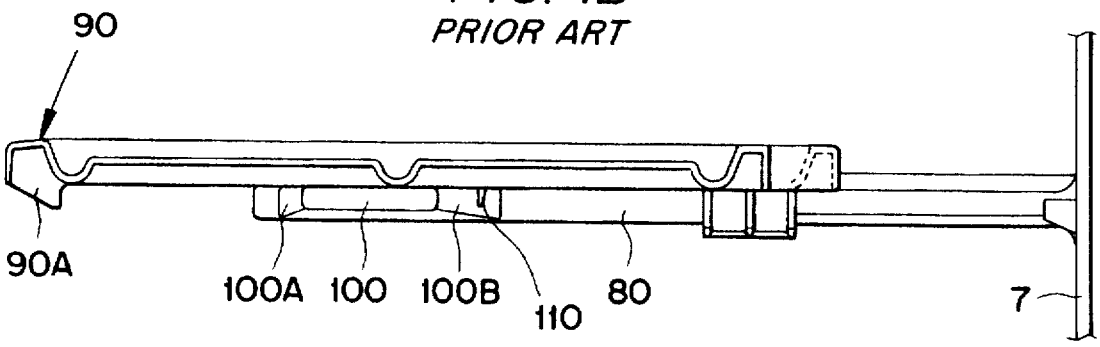
FIG. 1B PRIOR ART
Figure 2A:
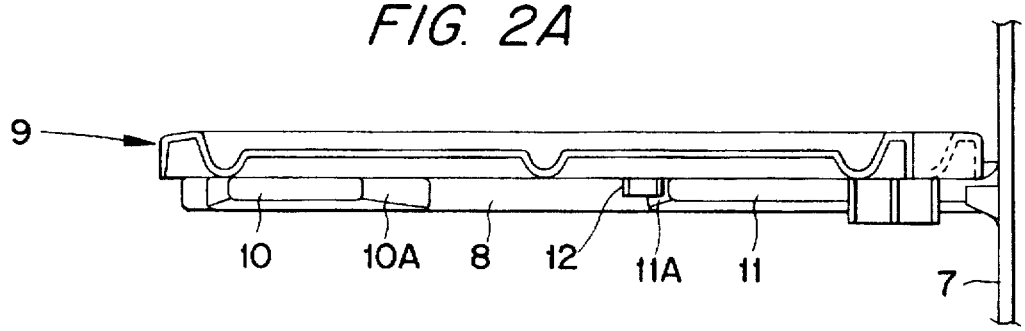
FIGS. 2A and 2B are sectional views respectively illustrating a shelf construction used in refrigerators in accordance with the present invention.
Figure 2B:
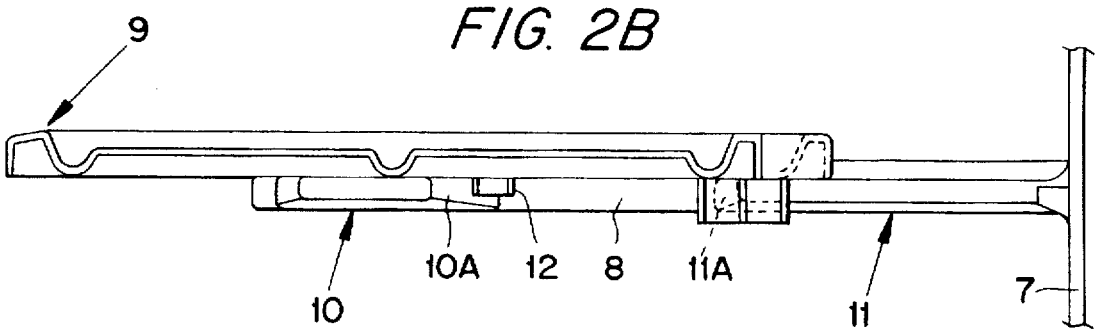

FIGS. 2A and 2B illustrate a shelf construction of a refrigerator in accordance with an embodiment of the present invention. In FIGS. 2A and 2B, elements respectively corresponding to those in FIGS. 1A and 1B are denoted by the same reference numerals.

As shown in FIGS. 2A and 2B, the construction includes a shelf 9 constructed to slide forwardly and rearwardly along guide rails 8 formed at both side walls of a refrigerator cabinet 7. In order to limit the forward and rearward sliding movements of the shelf 9, a pair of H-shaped stoppers 12 are respectively provided at opposite sides of the central portion of the shelf 9 such that they extend from the lower surface of the shelf 9. The stoppers 12 are integral with the shelf 9. A pair of beads 10 each having an inclined stop surface 10A are provided at respective front portions of the guide rails 8. Another pair of beads 11 each having an inclined stop surface 11A are also provided at respective rear portions of the guide rails 8. The surfaces 11A are spaced rearwardly from the surfaces 10A. The stoppers are disposed in an area boarded by the surfaces 10A and 11A. The stoppers 12 selectively come into contact with respective inclined surfaces 10A and 11A of the corresponding beads 10 and 11, thereby limiting the forward or rearward sliding movement of the shelf 9.

Now, the operation of the shelf construction according to the present invention will be described.

As the shelf 9, which is in a state that it forwardly protrudes from the refrigerator cabinet 7, is pushed to slide rearwardly along the guide rails 8 into the refrigerator cabinet 7, rearwardly facing abutment surfaces of the H-shaped stoppers 12 provided at the central portion of the shelf 9 come into contact with respective inclined surfaces 11A of the rear beads 11 on the guide rails 8, as shown in FIG. 2A, thereby preventing the shelf 9 from separating from their desired positions on the guide rails 8 or further sliding rearwardly into the refrigerator cabinet 7.

On the other hand, as the shelf 9 is pulled from the state of FIG. 2A to slide forwardly along the guide rails 8, forwardly facing abutment surface of the stoppers 12 come into contact with respective inclined surfaces 10A of the front beads 10 on the guide rails 8, as shown in FIG. 2B, thereby preventing the shelf 9 from separating from the refrigerator.

As apparent from the above description, the present invention provides a shelf construction of a refrigerator including a single stopper provided at each central portion of guide rails for guiding forward and rearward sliding movements of a shelf and adapted to prevent the shelf from separating from desired positions on the guide rails when the shelf is pushed or pulled. By virtue of such a construction of the stoppers, the shelf construction is simple. Accordingly, it is easy to form the shelf using the injection molding method. In particular, the shelf construction of the present invention is safe because the stoppers do not injure the user's hand even when the user forwardly pulls the shelf without taking special care.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising a housing forming an interior compartment accessible at a front end thereof, a pair of front-to-rear extending guide rails mounted in the compartment on respective opposite side walls thereof, and a shelf including two front-to-rear extending sides mounted on the guide rails for sliding movement thereon in forward and rearward directions, the improvement wherein each of the guide rails includes a first stop surface and a second stop surface spaced rearwardly from the first stop surface, the shelf including, at each of its front-to-rear extending sides, a rearwardly facing abutment surface and a forwardly facing abutment surface, said first abutment surface and said second abutment surface of each guide rail being disposed in an area bordered by a first stop surface and a second stop surface, whereby said forwardly facing abutment surfaces are engageable with said first stop surfaces during forward movement of the shelf, and said rearwardly facing abutment surfaces are engageable with said second stop surfaces during rearward movement of the shelf.

2.The refrigerator according to claim 1 wherein the forwardly facing abutment surfaces and the rearwardly facing abutment surfaces are of one-piece construction with the shelf.

3. The refrigerator according to claim 1 wherein the first and second abutment surfaces extend substantially perpendicular to a direction of sliding movement of the shelf.

* * * * *